US007499525B2

(12) United States Patent
Hörndler et al.

(10) Patent No.: US 7,499,525 B2
(45) Date of Patent: Mar. 3, 2009

(54) HEAT EXCHANGER FOR A DIAGNOSTIC X-RAY GENERATOR WITH ROTARY ANODE-TYPE X-RAY TUBE

(75) Inventors: Klaus Hörndler, Nürnberg (DE); Peter Schwarzbauer, Winkelhaid (DE); Michael Gunther, Nürnberg (DE)

(73) Assignee: Ziehm Imaging GmbH, Nuremberg (DE)

( * ) Notice: Subject to any disclaimer, the term of this patent is extended or adjusted under 35 U.S.C. 154(b) by 0 days.

(21) Appl. No.: 11/528,724

(22) Filed: Sep. 26, 2006

(65) Prior Publication Data

US 2007/0140430 A1 Jun. 21, 2007

(30) Foreign Application Priority Data

Oct. 15, 2005 (DE) ..... 10 2005 049 455

(51) Int. Cl.
*H01J 35/10* (2006.01)

(52) U.S. Cl. ..... 378/130; 378/141; 378/200

(58) Field of Classification Search ..... 378/130, 378/141, 200
See application file for complete search history.

(56) References Cited

U.S. PATENT DOCUMENTS

| | | | | |
|---|---|---|---|---|
| 2,319,350 | A * | 5/1943 | Schiebold | 378/71 |
| 2,900,543 | A * | 8/1959 | Heuse | 378/130 |
| 4,167,671 | A | 9/1979 | Boden et al. | |
| 4,417,171 | A | 11/1983 | Schmitmann | |
| 4,920,551 | A | 4/1990 | Takahashi et al. | |
| 4,928,296 | A * | 5/1990 | Kadambi | 378/141 |
| 5,703,926 | A * | 12/1997 | Bischof | 378/200 |
| 6,252,933 | B1 * | 6/2001 | Artig | 378/121 |
| 6,396,901 | B1 * | 5/2002 | Hell et al. | 378/130 |
| 7,025,502 | B2 * | 4/2006 | Freudenberger et al. | 378/200 |
| 7,079,624 | B1 * | 7/2006 | Miller et al. | 378/119 |
| 7,113,568 | B2 * | 9/2006 | Vadari et al. | 378/132 |
| 7,174,001 | B2 * | 2/2007 | Andrews et al. | 378/141 |

FOREIGN PATENT DOCUMENTS

| | | | |
|---|---|---|---|
| DE | 10222267 | A1 | 12/2003 |
| DE | 10342435 | A1 | 5/2005 |
| GB | 2323921 | A | 10/1998 |
| WO | WO0166490 | A2 | 9/2001 |

* cited by examiner

*Primary Examiner*—Edward J Glick
*Assistant Examiner*—Thomas R Artman
(74) *Attorney, Agent, or Firm*—Knobbe, Martens, Olson & Bear LLP

(57) ABSTRACT

A heat exchanger system for a single-tank x-ray generator of an x-ray diagnostic device with a rotating anode tube with a glass jacket is provided. The system provides for the thermal radiation emitted by the anode plate of the rotating anode tube, which glows during load operation, to be absorbed in very close proximity to the tube by a heat exchanger with a window for the exiting x-ray radiation beam, without causing other components inside the generator tank to be heated by the thermal radiation. The heat exchanger preferably includes the lead shield required to shield against x-ray back-radiation and has a cooling agent flowing through it. The layer of insulating oil present in the space between the rotating anode tube and the heat exchanger is exchanged by means of a pump against insulating oil from other areas of the tank so as to prevent local overheating of the insulating oil in the gap.

20 Claims, 2 Drawing Sheets

HEAT EXCHANGER FOR A DIAGNOSTIC X-RAY GENERATOR WITH ROTARY ANODE-TYPE X-RAY TUBE

CROSS-REFERENCE TO RELATED APPLICATIONS

This application claims the benefit of priority of German Patent Application No. DE102005049455.2 filed on Oct. 15, 2005, which is hereby incorporated by reference in its entirety.

BACKGROUND OF THE INVENTION

1. Field of the Invention

The present invention generally relates to cooling systems for x-ray diagnostic devices, and in particular, relates to a heat exchanger system for an x-ray generator with a rotary anode x-ray tube.

2. Description of the Related Art

X-ray diagnostic devices frequently incorporate single-tank generators in which the x-ray source and high voltage generating components are combined into one structural unit. During operation, significant amount of heat is typically generated by the device. Various heat exchanger systems for cooling oil-filled single-tank generators are known. Examples of heat exchangers developed for mobile x-ray apparatus are described in Applicant's co-pending German Patent Applications DE 102 22 267 A1 and DE 103 42 435 A1, which are hereby incorporated by reference in their entirety. In many of these devices, heat generated by an x-ray tube and the associated generator circuit is dissipated by a coolant circuit or heat exchanger located in the generator tank. The heat exchanger is typically disposed in the oil filling of the tank in the form of a spiral tube. This type of heat exchanger configuration has proven suitable for use with stationary anode x-ray tubes in which nearly the entire heat generated by the x-ray tube is dissipated via thermal conduction within the stationary anode to the surrounding oil that fills the generator tank.

In addition to stationary anodes, rotary anode-type x-ray tubes are also frequently used in x-ray diagnostic devices. Rotary anode x-ray tubes are well known and they generally include a rotating anode plate that is mounted within a vacuum housing and rotatably journalled by means of a magnetic bearing. When a rotary anode tube with a glass jacket is used in a single-tank generator, the heat generated is often many times that of devices with a stationary anode tube. During full-load operation, the majority of heat generated by the rotating anode tube is typically dissipated by means of thermal conduction of the glowing anode plate to the medium surrounding the glass jacket of the rotating anode tube. Because of the compact design of electronic components in a generator tank, components in close vicinity to the anode of the rotating anode tube are likely to be heated up by the thermal radiation emanating from the anode plate.

Thus, it will be appreciated that there is a need for an improved cooling system for a single-tank generator of an x-ray diagnostic device having a rotary anode x-ray tube. To this end, there is a need for an effective heat exchanger for such an x-ray generator which, during full-load operation, effectively dissipates heat from the rotating anode plate of the generator tank.

SUMMARY OF THE INVENTION

In one embodiment, the present invention provides an x-ray generator assembly adapted for use in x-ray imaging devices. The x-ray generator assembly comprises a reservoir, a rotary anode x-ray tube disposed in the reservoir, and a heat exchanging system. In one embodiment, the heat exchanging system comprises an enclosure wherein the enclosure is adapted to enclose the rotary anode x-ray tube, wherein the enclosure comprises a double wall defining a conduit for a cooling fluid to flow therethrough. In a preferred embodiment, the cooling fluid is circulated through the conduit defined by the double wall to remove heat generated from the rotary anode x-ray tube. In another preferred embodiment, a plurality of cut-outs are formed in the enclosure to permit transmission of a portion of the x-ray radiation generated by the x-ray generator to a location external to the generator. In yet another embodiment, a shield is formed on an exterior surface of the enclosure of the heat exchanger, wherein the shield is adapted to inhibit transmission of a second portion of the x-ray radiation generated by the generator. In yet another embodiment, the cooling fluid inside the heat exchanger is disposed about 20 mm or less from the rotary anode tube. In one implementation, the x-ray generator assembly is incorporated in a C-arm x-ray imaging system.

In another embodiment, the present invention provides a heat exchanger for an oil-filled single-tank generator of an x-ray diagnostic device with a rotating anode tube with a glass jacket. The heat exchanger is preferably made of a double-walled metal body through which a cooling agent is passed, which body encloses the rotating anode tube in the region of the anode plate at a distance of less than 20 mm. Preferably, the inside of the body is coated with a coating that absorbs infrared radiation and is perforated with a window for the passage of the useful x-ray radiation beam. Additionally, a circulating pump forces the oil filling of the generator tank to flow along the boundaries between the heat exchanger and the oil filling of the generator tank. In one implementation, the heat exchanger a shield on the outer surface for inhibiting transmission of the non-useful x-ray radiation and that a window for the useful x-ray radiation beam is disposed in the shield. In another implementation, the rotating anode tube is supported on the anode connection by a flange on the heat exchanger and that the flange has cutouts that allow the oil stream to pass perpendicular to the flange. In yet another implementation, the space between the rotating anode tube and the inside surface of the heat exchanger in the region of the cathode connections, an electrical infrared radiation-transmitting insulator is disposed. In yet another implementation, the flange is adjustably supported on the wall of the generator tank.

DETAILED DESCRIPTION OF THE PREFERRED EMBODIMENT

Figure 1:
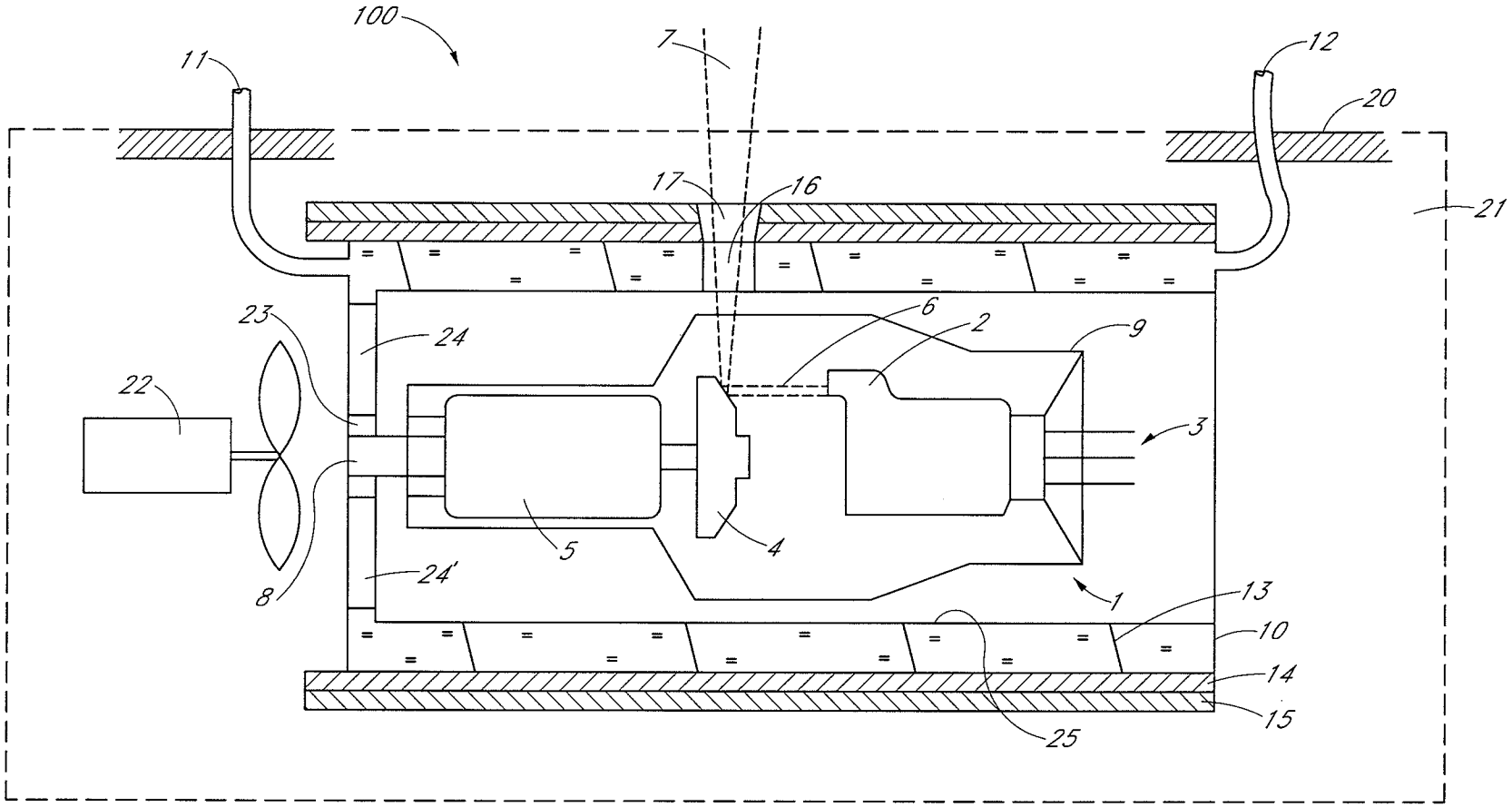
FIG. 1 schematically illustrates an x-ray generator assembly of one embodiment of the present invention including a heat exchanger adapted for removing heat from a rotating anode in the x-ray generator.

FIG. 1 is a schematic diagram of a cross-section view of an x-ray generator system 100 of one preferred embodiment of the present invention. The system 100 incorporates a novel heat exchanger system, which is designed to facilitate the dissipation of heat generated by a rotary anode tube so as to inhibit substantial heat from being transferred to the surrounding electronic components. As shown in Figure, the system 100 generally includes a generator tank or reservoir 20 that is filled with oil 21, a pump 22 adapted to circulate the oil 21, a rotary anode tube 1 disposed in the tank 20, and a heat exchanger system 10 that is positioned adjacent to the rotary anode tube 1 in the tank 20. The rotary anode tube 1 comprises an evacuated glass jacket 9 through which cathode connections 3 and anode connections are passed. The rotary anode tube 1 further includes an electron gun 2, an anode plate 4, and a rotary anode drive 5. An electron beam 6 generated in the electron gun 2 impinges on the anode plate 4 that is made to rotate by the rotary anode drive 5. The focal spot of the anode emits x-ray radiation which exits the tube in the form of the x-ray radiation beam 7. By decelerating the accelerated electrons in the anode plate 4, energy is introduced into the electrons during the operation of the x-ray tube, which energy causes the anode to be heated to temperatures of 1000° C. or higher. In one embodiment, the largest portion of the thermal energy stored in the anode plate 4 is emitted by thermal radiation. Additional descriptions of the general workings of rotary anode x-ray tubes can be found in U.S. Pat. Nos. 4,417,171, 4,167,671, and 4,920,551, which are hereby incorporated by reference in their entirety.

As further shown in FIG. 1, the heat exchanger 10 is disposed at a short distance from the rotating anode tube 1. In one embodiment, the distance between the heat exchanger 10 and the anode plate 4 is preferably less than 20 mm. In another embodiment, the heat exchanger 10 comprises a double-walled enclosure which substantially encloses the rotating the anode tube 1. A cooling agent, preferably water, flows through the double-wall jacket. In one implementation, the heat exchanger 10 optionally comprises a spiral tube that is coiled so as to form a cylinder. The spiral tube can be soldered or otherwise secured against a displacement of turns. In yet another embodiment, the heat exchanger 10 comprises a double-walled cylinder which, in the space between the two walls, contains one or more guiding devices 13 for conducting the stream of cooling agent. A surface 25 of the heat exchanger 10 that faces or is adjacent to the rotary anode tube 1 is preferably coated with a coating that effectively absorbs thermal radiation. In one embodiment, the surface 25 is coated with a black chromium coating.

In one embodiment, the cooling agent enters the heat exchanging system 10 via an inflow port 11 into the generator tank 20 and is fed to a cooling device (not shown) via a return port 12. Preferably, a pump (not shown) circulates the cooling agent through the system. A flange 23 is disposed on the heat exchanger 10 adjacent to the anode connection 8. The flange 23 has a plurality of cut-outs (24, 24') which preferably do not significantly impede the flow of oil generated by the circulating pump 22. In one embodiment, the flange 23 is adjustably supported on the wall of the generator tank 20.

In one embodiment, the exterior surface of the heat exchanger 10 is enclosed by an x-ray shield 14, 15. In one embodiment, the x-ray shield comprises a lead sheet wrapped around the heat exchanger 10. In another embodiment, the x-ray shield can further include a material, such as copper, which is capable of absorbing the characteristic x-ray radiation of the inside lead shield and ensures the mechanical stability of the lead shield.

In another embodiment, a plurality of windows 16, 17 are disposed in the shields 14, 15 of the heat exchanger 10 to permit the emitting of useful x-ray radiation beam. In another embodiment, to improve the electric strength of the configuration shown in FIG. 1, an insulator with a high transmissibility for infrared radiation is disposed in the space between the rotating anode tube 1 and the interior surface 25 of the heat exchanger 10, in particular in the region of the cathode connections 3, which insulator optionally has an aperture for the useful x-ray radiation beam 17 in the region of the window 16.

Advantageously, the heat exchanger of the preferred embodiments of the present invention effectively inhibits circuit elements (not shown) in the generator tank 20 from being overheated by the infrared radiation of the anode plate. With the assistance of the circulating pump 22, the heat generated by various electrical and electronic components in the generator tank 20 is conducted with the oil stream to the heat exchanger 10 and dissipated via the cooling agent.

Figure 2:
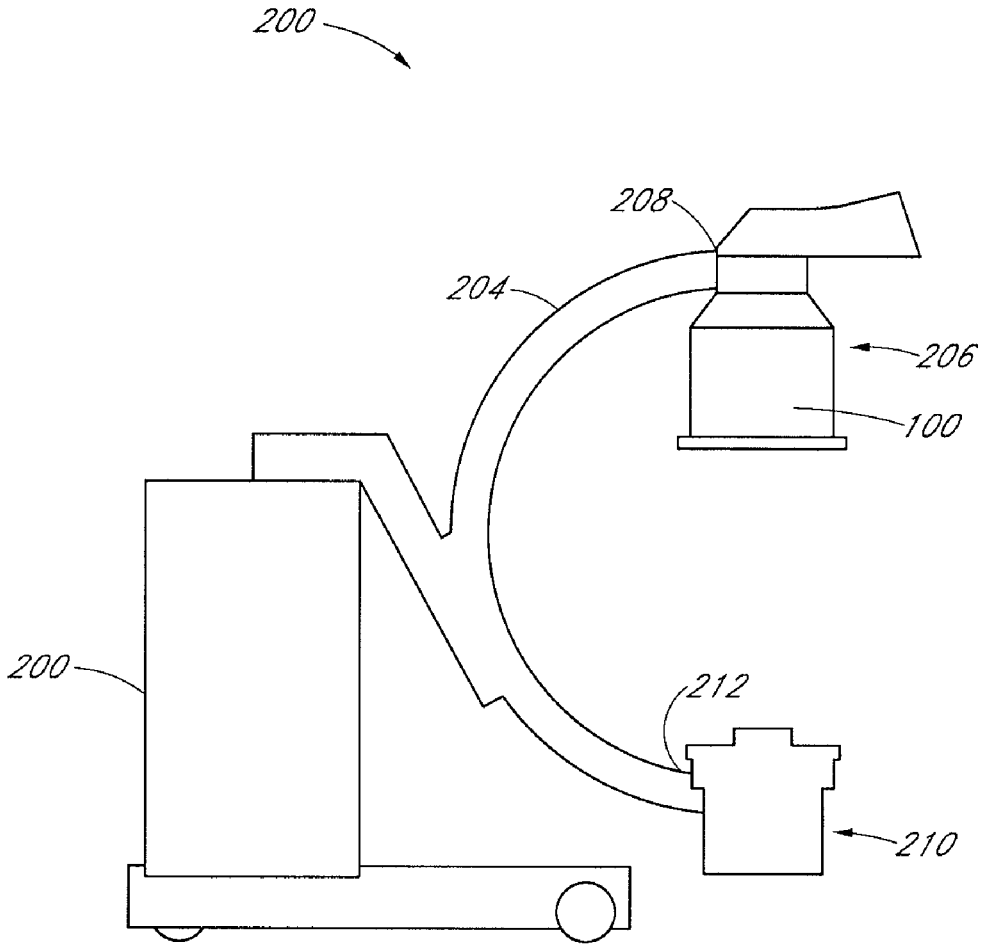
FIG. 2 schematically illustrates a mobile x-ray imaging system incorporating an x-ray generator assembly of one preferred embodiment of the present invention.

FIG. 2 schematically illustrates a mobile C-arm x-ray imaging system 200 incorporating an x-ray generator system of one preferred embodiment which contains a novel heat exchanger system designed for quick dissipation of heat generated by a rotary anode tube. As shown in FIG. 2, the imaging system 200 generally includes a chassis 202 connected to a C-arm 204. The C-arm 204 has an x-ray transmitter 206 disposed at a first end 208 and a receiver 208 disposed at a second end 212. In one embodiment, the x-ray generator system 100 is positioned in the x-transmitter 206 as shown in FIG. 2. It will also be appreciated that the x-ray generator system of the preferred embodiments incorporating the novel heat exchanger can be used in various x-ray imaging devices including conventional CT scans and the like.

Although the foregoing description of the preferred embodiments of the present invention has shown, described and pointed out the fundamental novel features of the invention, it will be understood that various omissions, substitutions, and changes in the form of the detail of the invention as illustrated as well as the uses thereof, may be made by those skilled in the art, without departing from the spirit of the invention. Particularly, it will be appreciated that the preferred embodiments of the invention may manifest itself in other shapes and configurations as appropriate for the end use of the article made thereby.

What is claimed is:

1. An x-ray generator assembly adapted for use in x-ray imaging devices, comprising:

a reservoir filled with oil;

a rotary anode x-ray tube disposed in said reservoir;

a heat exchanging system comprising an enclosure, wherein the enclosure is disposed in said reservoir and adapted to substantially enclose said rotary anode x-ray tube and to permit the oil to flow in a space between the enclosure and the rotary anode tube, said enclosure comprising a double wall defining a conduit for a cooling fluid, said cooling fluid adapted to be circulated into and out of said conduit and not to intermix with the oil in the reservoir;

wherein one or more cut-outs are formed in the enclosure to permit transmission of a portion of x-ray radiation from the rotary anode tube to a location external to the x-ray generator.

2. The x-ray generator assembly of claim 1, wherein a shield is formed on an exterior surface of the enclosure of the heat exchanger; said shield adapted to inhibit transmission of a second portion of x-ray radiation.

3. The x-ray generator assembly of claim 2, wherein the shield comprises a lead layer wrapped around the enclosure.

4. The x-ray generator assembly of claim 3, wherein the shield further comprises a copper layer surrounding the lead layer.

5. The x-ray generator assembly of claim 1, wherein the cooling fluid inside the heat exchanger is disposed about 20 mm or less from said rotary anode x-ray tube.

6. The x-ray generator assembly of claim 1, wherein the generator is adapted to be incorporated in a C-arm x-ray imaging system.

7. The x-ray generator assembly of claim 1, wherein the cooling fluid comprises water.

8. The x-ray generator assembly of claim 1, wherein one or more devices for guiding the circulation of the cooling fluid are disposed in the conduit of the enclosure.

9. The x-ray generator assembly of claim 8, wherein the one or more device comprises a spiral tube.

10. The x-ray generator assembly of claim 1, wherein the space between the enclosure and the rotary anode x-ray tube is less than about 20 mm in a region near an anode plate of the rotary anode x-ray tube.

11. The x-ray generator assembly of claim 1, wherein a surface of the enclosure that faces or is adjacent the rotary anode x-ray tube is coated with a coating that absorbs thermal radiation.

12. The x-ray generator assembly of claim 1, further comprising a pump to circulate the oil in the reservoir.

13. The x-ray generator assembly of claim 1, further comprising a pump to circulate the cooling fluid in the heat exchanger.

14. A heat exchanger for an x-ray generator system comprising a rotary anode x-ray tube disposed in an oil-filled tank, the heat exchanger comprising:

a double-walled enclosure that substantially encloses the rotary anode x-ray tube, the double-walled enclosure adapted to be disposed in the oil-filled tank so that oil can flow between an inner surface of the enclosure and the rotary anode x-ray tube, the inner surface coated with a coating that absorbs infrared radiation from the rotary anode x-ray tube, wherein the double-walled enclosure comprises a conduit adapted to permit flow of a cooling fluid into and out of the conduit, the cooling fluid separate from and not intermixed with the oil in the tank, and wherein the double-walled enclosure comprises a window configured to transmit x-rays from the rotary anode x-ray tube.

15. The heat exchanger of claim 14, wherein an x-ray shield encloses an exterior surface of the heat exchanger, the x-ray shield comprising a second window configured to transmit the x-rays from the rotary anode x-ray tube.

16. The heat exchanger of claim 14, further comprising a flange adjacent an anode connection for the rotary anode x-ray tube, the flange comprising a plurality of openings configured to permit flow of the oil therethrough.

17. The heat exchanger of claim 16, wherein the flange is adjustably supported on a wall of the tank.

18. The heat exchanger of claim 14, wherein the inner surface of the double-walled enclosure is spaced from the rotary anode x-ray tube by a distance less than 20 mm in a region near an anode of the x-ray tube.

19. The heat exchanger of claim 14, further comprising an inflow port and a return port configured to permit circulation of the cooling fluid in the heat exchanger.

20. The heat exchanger of claim 14, wherein an infrared-transmitting insulator is disposed between the inner surface of the enclosure and a cathode portion of the rotary anode x-ray tube.

* * * * *